US005561513A

United States Patent [19]

Lindblad

[11] Patent Number: 5,561,513

[45] Date of Patent: Oct. 1, 1996

[54] ENHANCED BRUSH DETONING BY ROTATING THE DETONING ROLL IN THE "WITH" DIRECTION

[75] Inventor: Nero R. Lindblad, Ontario, N.Y.

[73] Assignee: Xerox Corporation, Stamford, Conn.

[21] Appl. No.: 481,678

[22] Filed: Jun. 7, 1995

[51] Int. Cl.[6] ..... G03G 21/00

[52] U.S. Cl. ..... 355/301; 118/652; 15/256.52

[58] Field of Search ..... 355/301, 302; 118/652; 15/256.5, 256.51, 256.52

[56] References Cited

U.S. PATENT DOCUMENTS

| | | | |
|---|---|---|---|
| 4,494,863 | 1/1985 | Laing | 355/15 |
| 5,329,344 | 7/1994 | Gerbasi et al. | 355/301 |

FOREIGN PATENT DOCUMENTS

| | | | |
|---|---|---|---|
| 2632842 | 1/1977 | Germany | 355/302 |
| 58-140774 | 8/1983 | Japan | 355/302 |
| 58-153982 | 9/1983 | Japan | 355/302 |
| 58-176671 | 10/1983 | Japan | 355/302 |
| 1-116678 | 5/1989 | Japan | 355/302 |
| 0991360 | 1/1983 | U.S.S.R. | 355/302 |

*Primary Examiner*—R. L. Moses
*Attorney, Agent, or Firm*—T. L. Fair

[57] ABSTRACT

An apparatus for efficient detoning of a cleaner brush by rotating the brush and the moving detoning surface in the "with" mode direction through the detoning nip. The "with" mode of detoning prevents compression of the fibers through the detoning nip which shields the toner from detoning electric field in the detoning nip. The "with" mode opens up the initially compressed fibers such that detoning occurs through the detoning nip where maximum detoning can occur.

6 Claims, 4 Drawing Sheets

ENHANCED BRUSH DETONING BY ROTATING THE DETONING ROLL IN THE "WITH" DIRECTION

BACKGROUND OF THE INVENTION

This invention relates generally to an electrostatographic copier and/or printer, and more particularly concerns a cleaning apparatus.

Detoning rolls (e.g. anodized aluminum detoning rolls) for single and dual mini ESB (electrostatic brush) cleaners have been shown to be unable to remove the toner from the brush as rapidly as the brush removes the toner from the imaging surface (e.g. photoreceptor). As a result, the toner builds up in the brush. This build up of toner in the cleaner brush reduces the cleaning efficiency of the brush and redeposits toner back onto the photoreceptor. This low cleaning efficiency has been shown to occur at process speeds of 11.9 ips, with either very low or very high toner inputs.

The following disclosures may be relevant to various aspects of the present invention and may be briefly summarized as follows:

U.S. Pat. No. 5,329,344 to Gerbasi et al. discloses a cleaning method and apparatus that provides lubrication to a secondary detoning roll in a cleaner brush system, thus reducing cleaning failures. The toner particles removed from the first detoning roll are transported to the second detoning roll and reduces the wear problem of the second detoning roll due to lack of lubrication. The biased detoning rolls are located in adjacent proximity to the biased brushes to enable the detoning rolls to electrostatically remove toner from the brush fibers. The detoning rolls rotate in the same direction as that of the cleaner brushes.

U.S. Pat. No. 4,494,863 to Laing discloses a toner removal device for removing residual toner and debris from a charge retentive surface after transfer of toner images from the surface. This device is characterized by the use of a pair of detoning rolls, one for removing toner from a biased cleaner brush and the other for removing debris such as paper fibers and Kaolin from the brush. The rolls are electrically biased so that one of them attracts toner from the brush while the other one attracts debris. Thus, the toner can be reused without degradation of copy quality while the debris can be discarded.

SUMMARY OF INVENTION

Briefly stated, and in accordance with one aspect of the present invention, there is provided an apparatus for removing particles from a surface. The apparatus comprises means for removing the particles from the surface with the removing means having a direction of motion. Means for detoning the particles from the removing means with the detoning means having a direction of motion and being located adjacent the removing means. And, a detoning nip being a region between the removing means and the detoning means where the removing means contacts the detoning means. The removing means and the detoning means both have a "with" direction of motion in the detoning nip.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 6:
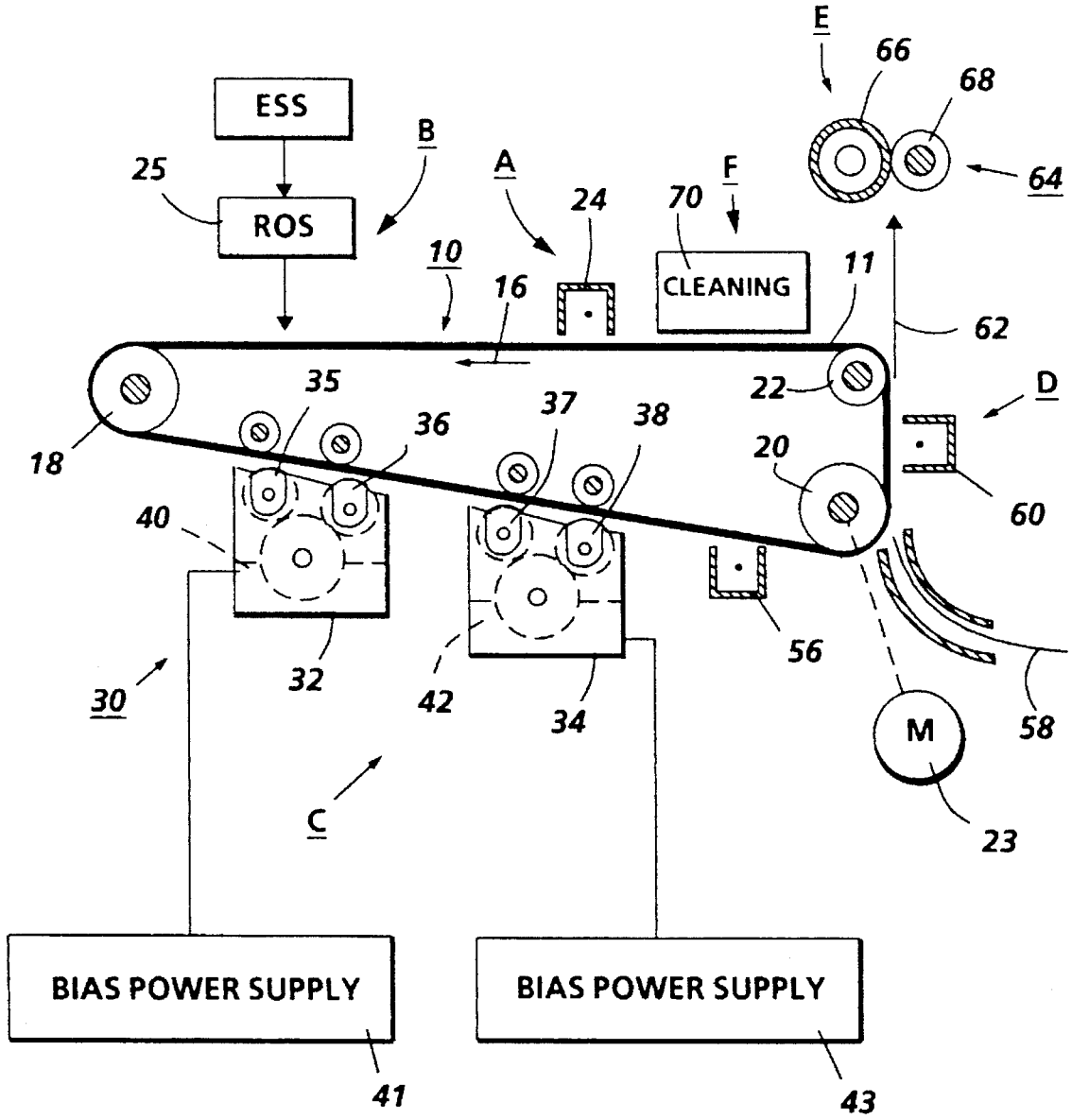
FIG. 6 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 6 will be briefly described.

A reproduction machine, in which the present invention finds advantageous use, utilizes a charge retentive member in the form of a photoconductive belt 10 consisting of a photoconductive surface and an electrically conductive, light transmissive substrate mounted for movement past a charging station A, an exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

Figure 5:
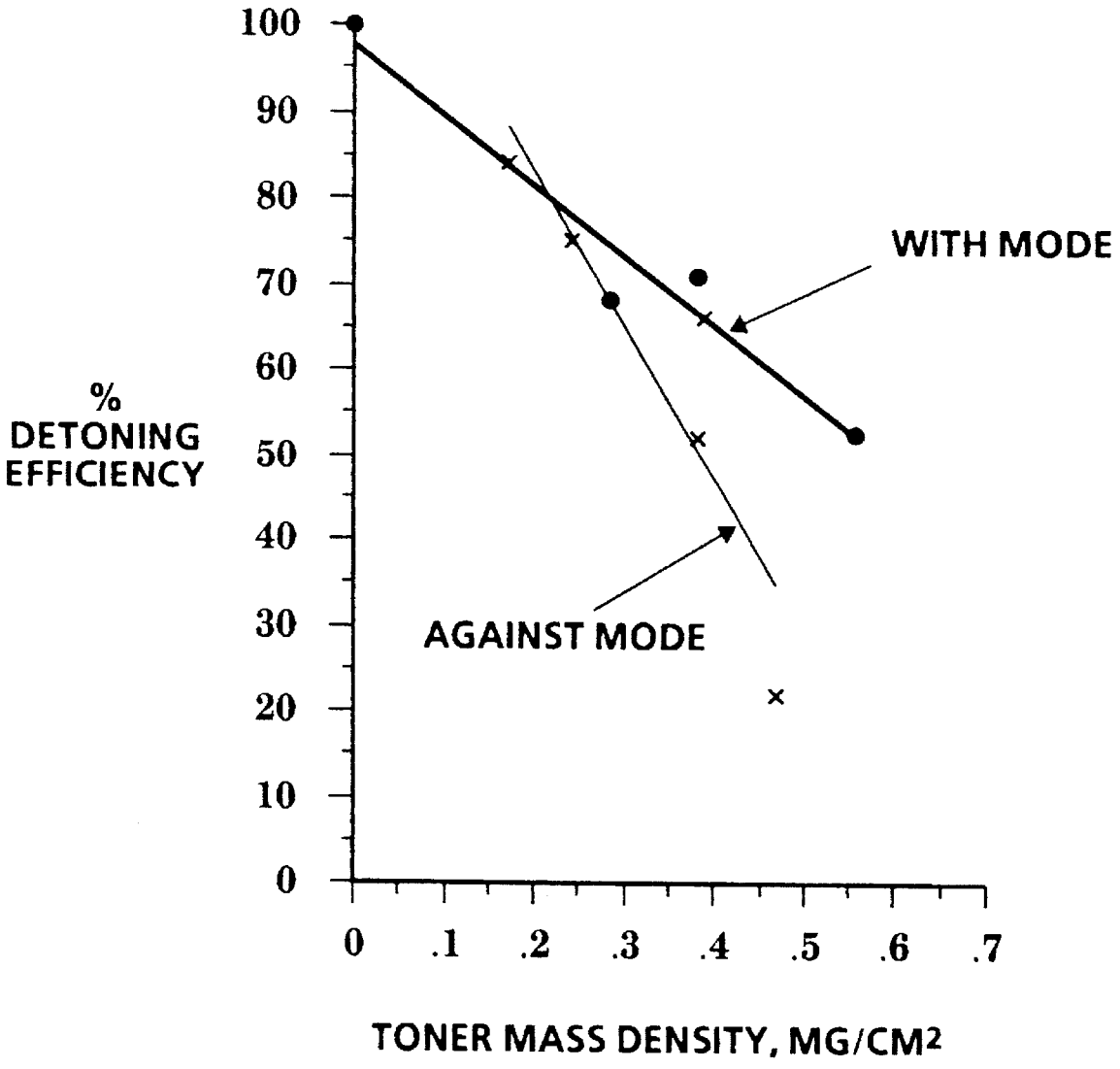
FIG. 5 is a graphical comparison of "with" mode detoning and "against" mode detoning.

As can be seen by further reference to FIG. 5, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). The resulting photoreceptor contains both charged-area images and discharged-area images.

At development station C, a development system, indicated generally by the reference numeral 30 advances developer materials into contact with the electrostatic latent images, and develops the image. The development system 30, as shown, comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40, by way of example, contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pre-transfer corona discharge member 56 is provided to condition the toner for effective transfer to a substrate using corona discharge of a desired polarity, either negative or positive.

Sheets of substrate or support material 58 are advanced to transfer station D from a supply tray, not shown. Sheets are fed from the tray by a sheet feeder, also not shown, and advanced to transfer station D through a corona charging device 60. After transfer, the sheet continues to move in the direction of arrow 62 to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a backup roller 68 with the toner powder images contacting fuser roller 66. In this manner, the toner powder image is permanently affixed to the sheet.

After fusing, copy sheets are directed to catch tray, not shown or a finishing station for binding, stapling, collating etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually.

Residual toner and debris remaining on photoreceptor belt 10 after each copy is made, are removed at cleaning station F with a cleaning system 70.

Figure 1:
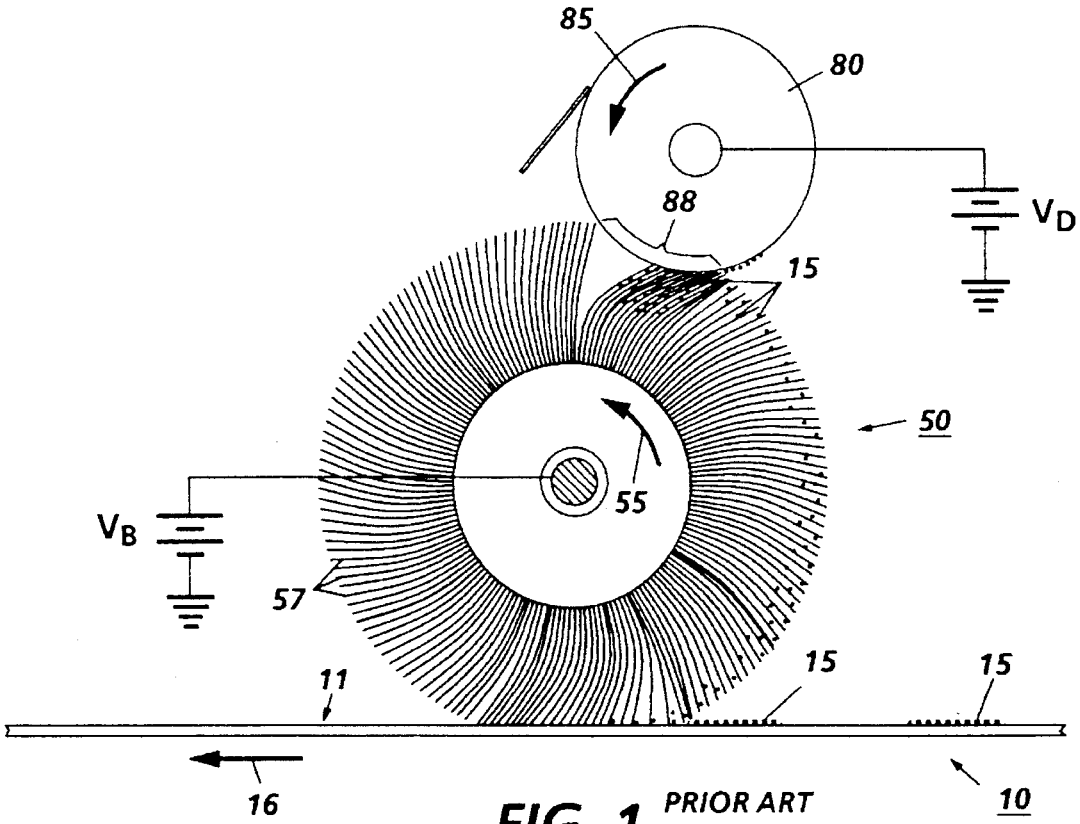
FIG. 1 PRIOR ART
FIG. 1 is a prior art elevational schematic view of the detoning roll rotating in the same direction as the cleaner brush.

Referring now to FIG. 1, which shows a prior art view of an elevational schematic of the detoning roll and the brush rotating in the same direction. The photoreceptor 10 moves in a direction, shown by arrow 16, which is opposite (i.e. against) the direction of motion of the brush 50, shown by arrow 55, where the brush fibers 57 and the photoreceptor surface 11 contact one another (i.e. brush/photoreceptor nip area).

With continuing reference to FIG. 1, brush detoning takes place when a potential (i.e. $V_B$, $V_D$) is applied to the brush 50 (e.g. $V_B$ is about +200 volts) and the detoning roll 80 (e.g. VD is about +500 volts) to attract the toner particles 15 (having negative charge) from the brush 50 to the detoning roll 80. This produces a detoning field between the brush 50 and the detoning roll 80 (e.g. equal to about 300 volts). In FIG. 1, the detoning roll 80 rotates (shown by arrow 85) in the same direction (shown by arrow 55) as that of the brush. However, at the brush fibers 57 and the detoning roll 80 nip area the brush 50 and the detoning roll 80 operate in an "against" mode. (i.e. The detoning roll 80 and the brush fibers 57 are moving in opposite directions (i.e. against one another) in the nip area.) This "against" mode causes poor detoning of the brush 50 due to brush fiber compression. Cleaning brushes normally comprise a high weave density and the fibers are short and stiff. This causes the fibers to compress as they enter the detoning nip upon striking the detoning roll 80. This compression shields the toner 15 in the fibers 57 from the detoning field. These compressed fibers 57 move through most of the detoning nip in a compressed state. When these fibers are compressed the toner can not be removed from the fibers because the toner is shielded from the detoning field. Near the exit of the detoning nip the fibers start to uncompress (i.e. flare out, expand apart), however, the detoning field has been passed when this occurs. Some toner 15 may be released during uncompression by the flicking action of the brush fibers 57 as they leave contact with the detoning roll 80. However, experimentation has shown that this poor detoning efficiency of the "against" mode is markedly improved by the present invention shown in FIG. 2, in which the "with" mode of detoning is used.

Figure 2:
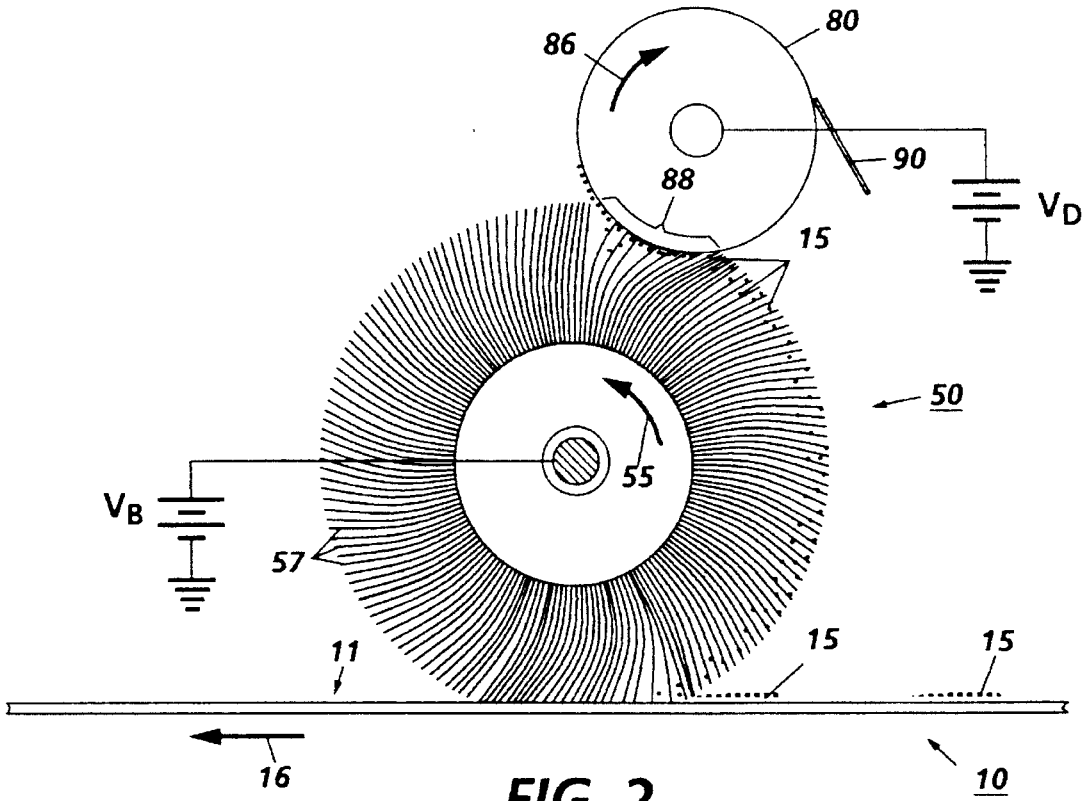
FIG. 2 is an elevational schematic view of an embodiment of the present invention showing the detoning roll rotating in an opposite direction then the cleaner brush relative to the cleaner brush direction of movement such that the detoning roll rotates in a "with" mode with the cleaner brush.

Reference is now made to FIG. 2, which shows an elevational schematic view of an embodiment of the present invention where the detoning roll rotates opposite the direction of rotation of the cleaner brush. However, the detoning roll 80, rotating in a direction shown by arrow 86, moves in the "with" mode of the cleaner brush 50, rotating in a directions shown by arrow 55, in the detoning nip region.

With continuing reference to FIG. 2, the present invention discloses that by rotating the detoning roll 80 in the "with" mode the brush fibers 57 can be opened up, and the toner 15 can be removed from the brush with the detoning field in the detoning nip 88. Rotating the detoning roll in the "with" mode opens the compressed bundle containing toner particles created by the fibers 57 of the cleaning brush 50. The detoning roll 80 speed should be between about three to ten times faster than the tip velocity of the brush fibers 57. The toner particles 15, attracted to the detoning roll 80, are removed from the detoning roll 80 by a scraper blade 90, shown here in the doctoring mode.

To understand the significant benefit that occurs due to the present invention, it must first be understood in more detail how poor detoning occurs. For example, small mini single or dual ESB brushes are only one inch in diameter, and have a pile height of about 7 mm and a weave density of 60k fibers per square inch, or greater. Therefore, these fibers are stiffer and bend differently than the long fibers used in the brushes of other machines (e.g. Xerox machines 4850, 4890, 5100, and 5090).

Figure 3:
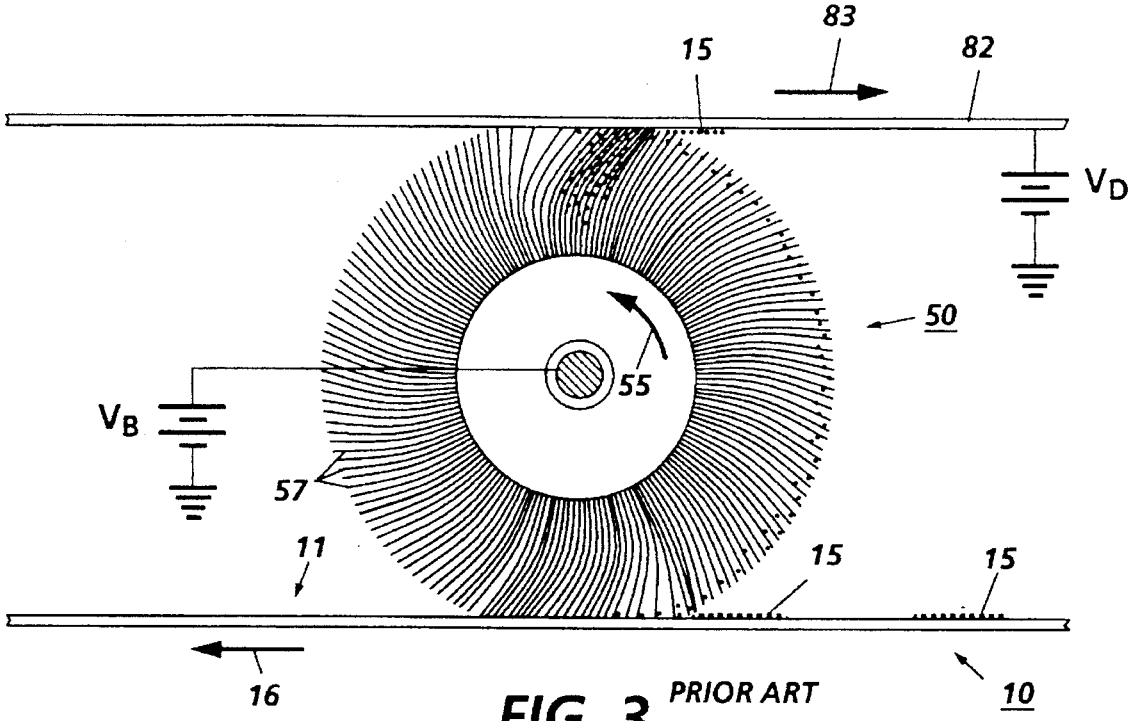
FIG. 3 PRIOR ART
FIG. 3 is a prior art view of an elevational schematic view of the cleaner brush rotating in an "against" mode for detoning relative to the direction of motion of a moving surface.
Figure 4:
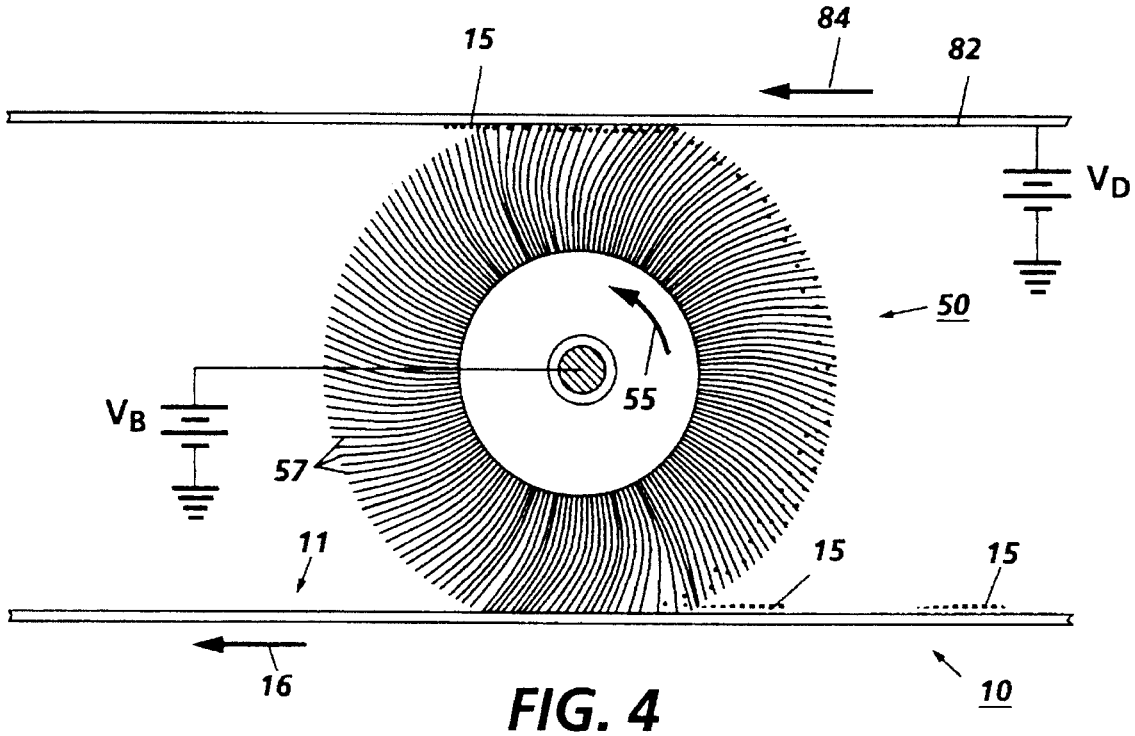
FIG. 4 is an elevational schematic view of an embodiment of the present invention showing the cleaner brush rotating in a "with" mode for detoning relative to the direction of motion of the moving surface.

Reference is now made to FIGS. 3 and 4, which show elevational schematics of a cleaner brush and a moving surface for detoning in the "against" and "with" modes, respectively. In another embodiment of the present invention, the detoning efficiency can also be enhanced by rotating the detoning roll (or detoning surface) in the same direction as the brush (i.e. unlike the embodiment of the present invention shown in FIG. 2 where the directions of motion are opposite one another), but at a higher velocity.

With reference to FIG. 3, the cleaner brush 50 rotates in the direction shown by arrow 55 and the moving detoning surface 82 moves in a direction (shown by arrow 83) opposite to the rotational direction of the cleaner brush 50. (This "against" mode was simulated experimentally using a moving flat glass surface 82 for detoning, with a rotating brush 50 and the interference, between these surfaces, set to 1 mm.) As can be seen in FIG. 3, the brush fibers 57 compress as they enter the detoning nip 58 in the "against" mode. The compression is worse as the interference between the brush and the flat surface is increased.

However, when the flat surface is moved in the "with" mode, shown in FIG. 4, the fibers 57 entering the detoning nip 58 initially compress, but are quickly prevented from compressing (i.e. straightened out or opened up) by the direction of movement (shown by arrow 84) of the moving flat surface 82. The moving flat surface 82 moves in the same direction as the rotational direction of brush 50. This opening up of the fibers allows the detoning field to remove toner from the brush fibers 57.

In this embodiment of the present invention, the brush fibers 57 stop compressing and begin to open up when the velocity of the flat surface or a cylindrical detoning roll is about three times greater than the tip velocity of the fibers. And a very pronounced opening occurs when the velocity of the flat surface 82, (i.e., the detoning surface) is greater than five times the brush tip velocity. (The speed of the detoning roll surface).

Referring now to FIG. 5, which shows graphically the experimental results of the comparison of "with" mode detoning and "against" mode detoning. The "with" mode detoning of the present invention improves detoning efficiency. For example, when the input mass density to the cleaner is greater than 0.2 mg/cm$^2$, the detoning efficiency increases significantly. At higher mass densities, the toner match head on a brush fiber extends further down the fiber. Thus, in the "against" mode, the toner that is further away from the fiber tip cannot be removed by the detoning electric field because the toner is shielded by the fibers compressed in a fiber bundle. Whereas, in the "with" mode, the fibers are opened up and the detoning electric field penetrates the brush and removes the toner. This is particularly important in cases where paper jams occur and leave untransferred toner on the photoreceptor. This toner can have a mass density ranging from 0.5 to 1.2 mg/cm$^2$. The cleaner is required to remove this toner from the photoreceptor, and in doing so, the brush becomes quickly saturated with toner. This toner moves to the core of the brush and is difficult to remove unless vacuumed or the brush is replaced.

In recapitulation, the present invention involves detoning of a cleaner brush using "with" mode detoning. The "with" mode of detoning is the movement of the brush fibers in the same direction as the detoning surface in the detoning nip area. In the present invention, the direction of rotation between the cleaning brush and the moving surface for detoning can be in opposite directions (see FIG. 2), or detoning in the same direction to create the "with" detoning mode of the present invention (see FIG. 4). Thus, the present invention involves the use of "with" detoning in the cleaner/detoning nip, and not the direction of rotational movement of the contacting surfaces (i.e. the cleaner brush and the detoning surface).

It is, therefore, apparent that there has been provided in accordance with the present invention, a cleaning apparatus that detones in the "with" mode that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing particles from a first surface, comprising:

means for cleaning the particles from the surface, said cleaning means having a direction of motion;

means for removing the particles from said cleaning means, said removing means having a direction of motion and being located adjacent said cleaning means;

a detoning nip being a region between said cleaning means and said removing means where said cleaning means contacts said removing means, said cleaning means and said removing means both having a "with" direction of motion in said detoning nip, said cleaning means comprising a rotatable brush having a plurality of fibers extending radially from a core and said removing means comprising a moving second surface, said "with" mode comprises said brush rotating in the same direction as said moving second surface, in said detoning nip, such that said plurality of fibers of said brush are opened up through said detoning nip, enabling enhanced removal of the particles therein from said plurality of fibers; and the direction of motion of said moving second surface having a same direction of motion as said brush such that said moving second surface has movement at least about three times greater than a, velocity of said fibers of said brush as said brush rotates.

2. An apparatus as recited in claim 1, wherein said moving second surface comprises a roll.

3. An apparatus as recited in claim 1, wherein said moving second surface comprises the first surface.

4. An apparatus as recited in claim 2, wherein said "with" mode comprises said brush rotating in the same direction as said roll, in said detoning nip, such that said plurality of fibers of said brush are opened up through said detoning nip, enabling enhanced removal of the particles therein from said plurality of fibers.

5. An apparatus as recited in claim 1, wherein said plurality of fibers comprise fiber tips at the end of said plurality of fibers extending radially outward opposite said core of said brush.

6. An apparatus as recited in claim 5, wherein said fiber tips rotate as said brush rotates creating a velocity of said fiber tips.

* * * * *